US006802380B2

(12) United States Patent
Blackman

(10) Patent No.: US 6,802,380 B2
(45) Date of Patent: Oct. 12, 2004

(54) PRESSURE RELIEF SYSTEM AND METHODS OF USE AND MAKING

(75) Inventor: Mark P. Blackman, Lewisville, TX (US)

(73) Assignee: Halliburton Energy Services Inc., Houston, TX (US)

( * ) Notice: Subject to any disclaimer, the term of this patent is extended or adjusted under 35 U.S.C. 154(b) by 37 days.

(21) Appl. No.: 10/234,446

(22) Filed: Sep. 3, 2002

(65) Prior Publication Data

US 2003/0062200 A1 Apr. 3, 2003

Related U.S. Application Data

(60) Provisional application No. 60/316,439, filed on Aug. 31, 2001.

(51) Int. Cl.[7] ..... E21B 10/22

(52) U.S. Cl. ..... 175/228; 175/337; 175/359; 175/372

(58) Field of Search ..... 175/227, 228, 175/371, 372, 359, 370, 337; 384/94; 184/54; 277/637, 641, 644, 647, 336

(56) References Cited

U.S. PATENT DOCUMENTS

| | | | | |
|---|---|---|---|---|
| 3,721,306 | A | | 3/1973 | Sartor |
| 4,223,749 | A | | 9/1980 | Bodine et al. |
| 4,244,430 | A | | 1/1981 | Raiburn |
| 4,262,759 | A | | 4/1981 | Young et al. |
| 4,274,498 | A | | 6/1981 | Penny |
| 4,284,151 | A | | 8/1981 | Levefelt |
| 4,328,873 | A | | 5/1982 | González |
| 4,335,791 | A | | 6/1982 | Evans |
| 4,390,072 | A | | 6/1983 | Phelan |
| 4,427,307 | A | * | 1/1984 | Norlander et al. ..... 384/94 |
| 4,509,607 | A | | 4/1985 | Saxman et al. |
| 4,552,228 | A | | 11/1985 | Evans et al. |
| 4,577,705 | A | | 3/1986 | Cross |
| 4,588,309 | A | | 5/1986 | Uyehara et al. |
| 4,597,455 | A | | 7/1986 | Walters et al. |
| 4,768,598 | A | | 9/1988 | Reinhardt |
| 4,865,136 | A | | 9/1989 | White |
| 4,942,930 | A | | 7/1990 | Millsapps, Jr. |
| 5,072,795 | A | | 12/1991 | Delgado et al. |
| 5,080,183 | A | | 1/1992 | Schumacher et al. |
| 5,099,932 | A | | 3/1992 | Hixon |
| 5,363,930 | A | | 11/1994 | Hern |
| 5,477,934 | A | | 12/1995 | Strand |
| 5,490,570 | A | | 2/1996 | Millsapps, Jr. |
| 5,520,257 | A | | 5/1996 | Crews |
| 5,558,172 | A | | 9/1996 | Millsapps, Jr. |
| 5,628,375 | A | | 5/1997 | Daly |
| 5,931,241 | A | | 8/1999 | Daly |
| 6,092,611 | A | | 7/2000 | Saxman |
| 6,109,790 | A | | 8/2000 | von Gynz-Rekowski et al. |
| 6,138,778 | A | | 10/2000 | Price et al. |
| 6,170,611 | B1 | | 1/2001 | Daly |
| 6,196,339 | B1 | | 3/2001 | Portwood et al. |
| 6,202,766 | B1 | | 3/2001 | Shepherd |
| 6,206,110 | B1 | | 3/2001 | Slaughter, Jr. et al. |
| 6,213,228 | B1 | | 4/2001 | Saxman |
| 6,494,465 | B1 | * | 12/2002 | Bucknell ..... 277/641 |

* cited by examiner

*Primary Examiner*—David Bagnell
*Assistant Examiner*—Matthew J. Smith
(74) *Attorney, Agent, or Firm*—Groover & Holmes

(57) ABSTRACT

A roller-cone rock bit in which the compensation reservoir is integrated with a hydrostatically-asymmetric seal, such as a V-seal, which provides pressure relief. This seal not only relieves overpressure during filling, and when the grease thermally expands as the bit first goes downhole, but also compensates transient overpressures during operation.

33 Claims, 7 Drawing Sheets

PRESSURE RELIEF SYSTEM AND METHODS OF USE AND MAKING

CROSS-REFERENCE TO OTHER APPLICATION

This application claims priority from provisional 60/316,439 filed Aug. 31, 2001, which is hereby incorporated by reference.

BACKGROUND AND SUMMARY OF THE INVENTION

The present invention relates to earth-penetrating drill bits, and particularly to pressure compensation systems in so-called roller-cone bits.

1. Background

Rotary Drilling

Oil wells and gas wells are drilled by a process of rotary drilling, using a drill rig such as is shown in FIG. 3. In conventional vertical drilling, a drill bit 110 is mounted on the end of a drill string 112 (drill pipe plus drill collars), which may be several miles long, while at the surface a rotary drive (not shown) turns the drill string, including the bit at the bottom of the hole.

Two main types of drill bits are in use, one being the roller cone bit, an example of which is seen in FIG. 2. In this bit a set of cones 116 (two are visible) having teeth or cutting inserts 118 are arranged on rugged bearings. As the drill bit rotates, the roller cones roll on the bottom of the hole. The weight-on-bit forces the downward pointing teeth of the rotating cones into the formation being drilled, applying a compressive stress which exceeds the yield stress of the formation, and thus inducing fractures. The resulting fragments are flushed away from the cutting face by a high flow of drilling fluid.

The drill string typically rotates at 150 rpm or so, and sometimes as high as 1000 rpm if a downhole motor is used, while the roller cones themselves typically rotate at a slightly higher rate. At this speed the roller cone bearings must each carry a very bumpy load which averages a few tens of thousands of pounds, with the instantaneous peak forces on the bearings several times larger than the average forces. This is a demanding task.

2. Background

Bearing Seals

In most applications where bearings are used, some type of seal, such as an elastomeric seal, is interposed between the bearings and the outside environment to keep lubricant around the bearings and to keep contamination out. In a rotary seal, where one surface rotates around another, some special considerations are important in the design of both the seal itself and the gland into which it is seated.

The special demands of sealing the bearings of roller cone bits are particularly difficult. The drill bit is operating in an environment where the turbulent flow of drilling fluid, which is loaded with particulates of crushed rock, is being driven by hundreds of pump horsepower. The flow of mud from the drill string may also carry entrained abrasive fines. The mechanical structure around the seal is normally designed to limit direct impingement of high-velocity fluid flows on the seal itself, but some abrasive particulates will inevitably migrate into the seal location. Moreover, the fluctuating pressures near the bottomhole surface mean that the seal in use will see forces from pressure variations which tend to move it back and forth along the sealing surfaces. Such longitudinal "working" of the seal can be disastrous in this context, since abrasive particles can thereby migrate into close contact with the seal, where they will rapidly destroy it.

Commonly-owned U.S. application Ser. No. 09/259,851, filed Mar. 1, 1999 and now issued as Ser. No. 6,279,671 (Roller Cone Bit With Improved Seal Gland Design, Panigrahi et al.), copending (through continuing application Ser. No. 09/942,270 filed Aug. 27, 2001 and hereby incorporated by reference) with the present application, described a rock bit sealing system in which the gland cross-section includes chamfers which increase the pressure on the seal whenever it moves in response to pressure differentials. This helps to keep the seal from losing its "grip" on the static surface, i.e. from beginning circumferential motion with respect to the static surface. FIG. 4 shows a sectional view of a cone according to this application; cone 116 is mounted, through rotary bearings 12, to a spindle 117 which extends from the arm 46 seen in FIG. 1. A seal 20, housed in a gland 22 which is milled out of the cone, glides along the smooth surface of spindle 117 to exclude the ambient mud 21 from the bearings 12. (Also visible in this Figure is the borehole; as the cones 116 rotate under load, they erode the rock at the cutting face 25, to thereby extend the generally-cylindrical walls 25 of the borehole being drilled.) The present application discloses a different sealing structure, in place of the seal 20 and gland 22, but FIG. 4 gives a view of the different conventional structures which the seal protects and works with.

A critical part of the design of a "roller cone" drill bit is the sealing system. The roller cone bit, unlike any fixed-cutter bit, requires its "cones" to rotate under heavy load on their bearings; when the bearings fail, the bit has failed. The drilling fluid which surrounds the operating bit is loaded with fragments of crushed rock, and will rapidly destroy the bearings if it reaches them. Thus it is essential to exclude the drilling fluid from the bearings.

Rock bit seals are exposed to a tremendously challenging fluid environment, in which large amounts of abrasive rock particles and fines are entrained in the fluid near one side of the seal. Moreover, the very high-velocity turbulent flows cause fluctuating pressures near the seals.

Fluid seals are therefore an essential part of the design of most roller-cone bits. However, an important aspect of seal functioning is control of differential pressures; if the pressure inside the seal becomes substantially less than the pressure outside the seal, particulates from the drilling fluid can be pushed into or past the dynamic face. (This can lead to rapid destruction of the seal.) A pressure compensation arrangement is therefore normally used to equalize these pressures.

The life of a rotary-cone drill bit is usually limited by bearing failure, and that in turn is heavily dependent on proper sealing and lubrication. Such bits usually include a grease reservoir in each arm, connected to supply grease to that arm's bearings. Since the bearing will operate at low speeds, high load, and fairly high temperature (possibly 250° F. or higher), the grease used is typically quite stiff at room temperature. However, to provide pressure equalization between the reservoir and the bearings, it is desirable to avoid air pockets in the grease.

When the grease reservoir is filled at the factory, a vacuum is usually applied to remove trapped air, and then the grease is injected under some pressure (e.g. 2000 psi or so). The reservoir's pressure-relief valve operates to limit the pressure inside the reservoir to an acceptable level, but this still implies a positive pressure which slightly distends the reservoir's elastomeric diaphragm.

With the old hydrodynamic seals, where some grease leakage past the seal was intentionally designed in, depletion of the reservoir during the service lifetime was a major concern. However, this is not much of a concern anymore. Thus the main purposes of the reservoir now are to assist in complete filling of the bearing and passageways, and to provide pressure compensation in-service.

The normal pressure compensation arrangement uses a tough concave diaphragm to transmit the pressure variations from the neighborhood of the cones to the bearings. The diaphragm is typically filled with grease, and is fluidly connected (on its concave side) through a grease-filled passageway to the grease volume inside the seal. The exterior of the diaphragm is fluidly connected, through a weep hole, to the volume of drilling fluid below the bit body.

One current production system uses a pierced rubber plug (which is separate from the diaphragm) for pressure relief. However, since the phase of pressure transient waves at this plug will not precisely match with those at the diaphragm, this can result in underprotection or overprotection by the plug (i.e. insufficient OR excessive extrusion of grease). Moreover, it was found that the frequent transients seen at the plug would fatigue it.

Pressure Relief System

The present application discloses roller-cone-type bits and methods where a modified pressure compensation structure is used to keep the pressure differential across the dynamic rotary seal within a predetermined operating range. In various embodiments, the pressure relief valve is either made integral with (or very closely coupled to) the lubricant reservoir's diaphragm. Thus there is little or no phase shift between the diaphragm and the pressure relief valve, and overpressures are accurately limited. Preferably this is achieved by using a hydrostatically-asymmetric seal, which is integrated with or in proximity to the diaphragm, as the pressure relief valve.

In one class of embodiments, the lip of the concave diaphragm is turned back to make a seal which faces in the desired direction. (That is, the direction of lubricant flow into the concavity is the same as the "easy" direction of lubricant flow past the seal.) This choice is somewhat surprising, since it requires some care in the assembly operation (and appropriate chamfering to not tear the seal edge during assembly); but this turned-back lip provides several advantages. First, the overpressure bypass path is very close to the interior of the diaphragm. Second, the overpressure bypass path is short. Third, when vacuum is applied before grease is injected, the preferred lip seal will hold vacuum for the necessary time. Fourth, this orientation permits an overall reservoir design which is very compatible with existing bit designs. Fifth, the overall piece count is not increased.

Thus one advantage of the hydrostatically-asymmetric-seal pressure relief is its close proximity to the diaphragm.

Another advantage is the relatively low fluid impedance of the seal once fluid bypass flow begins.

Another advantage is simple manufacturing.

BRIEF DESCRIPTION OF THE DRAWING

The disclosed inventions will be described with reference to the accompanying drawings, which show important sample embodiments of the invention and which are incorporated in the specification hereof by reference, wherein:

FIG. 1A shows the bladder, with a hydrostatically-asymmetric seal as its lip, in place in the pressure compensator. FIG. 1B shows how the hydrostatically-asymmetric seal of this embodiment allows free flow in one direction, and FIG. 1C shows how this seal blocks reverse flow.

FIG. 1D provides an sectional view of the bladder, with a hydrostatically-asymmetric seal as its turned-down lip, in place in the pressure compensator, and FIG. 1E shows the path of bypass (free) flow in this embodiment.

DETAILED DESCRIPTION OF THE PREFERRED EMBODIMENTS

The numerous innovative teachings of the present application will be described with particular reference to the presently preferred embodiment (by way of example, and not of limitation).

The present application discloses roller-cone-type bits and methods where a modified pressure compensation structure is used to keep the pressure differential across the dynamic rotary seal within a predetermined operating range. In various embodiments, the pressure relief valve is either made integral with (or very closely coupled to) the lubricant reservoir's diaphragm. Thus there is little or no phase shift between the diaphragm and the pressure relief valve, and overpressures are accurately limited. Preferably this is achieved by using a hydrostatically-asymmetric seal, which is integrated with or in proximity to the diaphragm, as the pressure relief valve.

In one class of embodiments, the lip of the concave diaphragm is turned back to make a seal which faces in the desired direction. (That is, the direction of lubricant flow into the concavity is the same as the "easy" direction of lubricant flow past the seal.) This choice is somewhat surprising, since it requires some care in the assembly operation (and appropriate chamfering to not tear the seal edge during assembly); but this turned-back lip provides several advantages. First, the overpressure bypass path is very close to the interior of the diaphragm. Second, the overpressure bypass path is short. Third, when vacuum is applied before grease is injected, the preferred lip seal will hold vacuum for the necessary time. Fourth, this orientation permits an overall reservoir design which is very compatible with existing bit designs. Fifth, the overall piece count is not increased.

The term "hydrostatically-asymmetric seal" is used, in the present application, to refer to seals which allow fluid passage easily in only one direction. A simple example (and the presently preferred embodiment) is the vee-lip seal. However, many other seal designs are possible, as detailed in the Seals and Sealing Handbook (4.ed. M. Brown 1995).

Embodiments with Pass-Through Pressure Relief

Figure 1A:
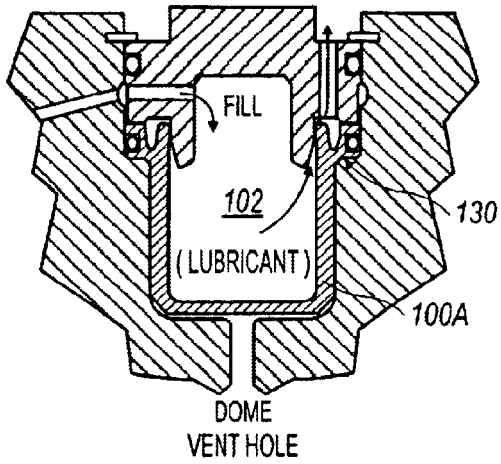
FIGS. 1A–1C show a first embodiment, in which a hydrostatically-asymmetric seal is integrated with the bladder (concave diaphragm) of the pressure compensator.
Figure 1B:
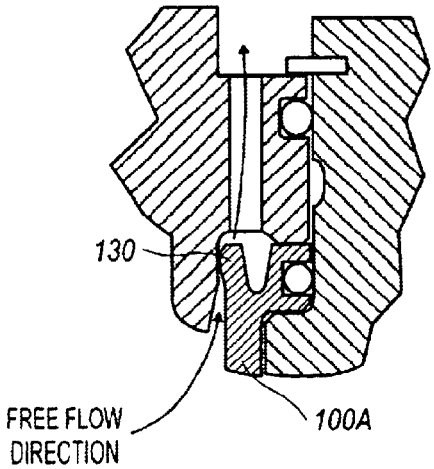
Figure 1C:
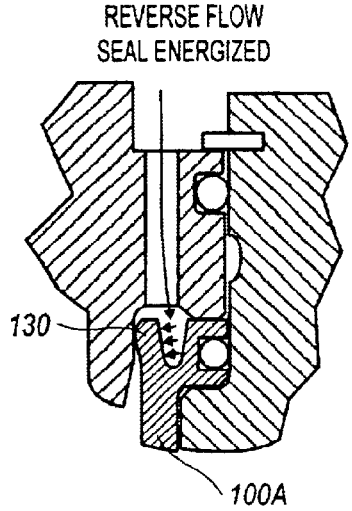

FIGS. 1A–1C show a first sample embodiment, in which a hydrostatically-asymmetric seal 130 is integrated with the bladder (concave diaphragm) 100A of the pressure compensator 100. FIG. 1A shows the bladder 100A, with a hydrostatically-asymmetric seal 130 as its lip, in place in the pressure compensator. FIG. 1B shows how the hydrostatically-asymmetric seal 130 of this embodiment allows free flow in one direction, and FIG. 1C shows how this seal 130 blocks reverse flow.

Note that in these embodiments the lubricant first passes into the concavity 102, and only from there escapes past the seal (pressure relief valve) to relieve overpressure.

Embodiments with Paralleled Pressure Relief

Figure 1D:
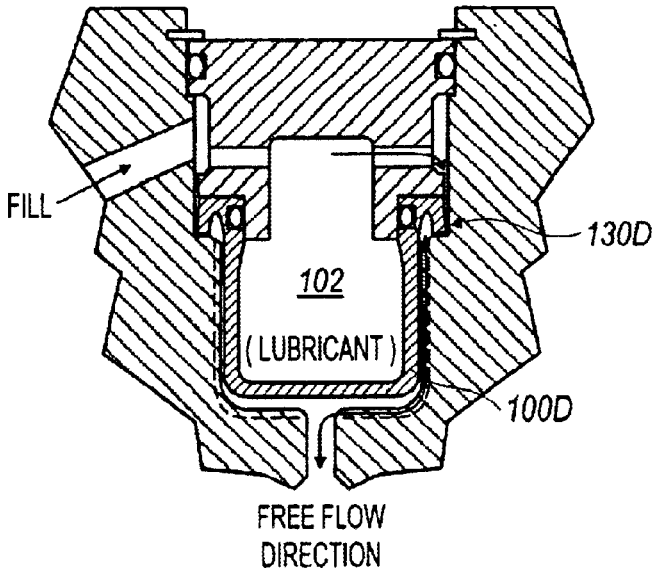
FIGS. 1D–1E show a second embodiment, in which a hydrostatically-asymmetric seal is still integrated with the bladder (concave diaphragm) of the pressure compensator, but is turned in the opposite direction to the embodiment of FIG. 1A.
Figure 1E:
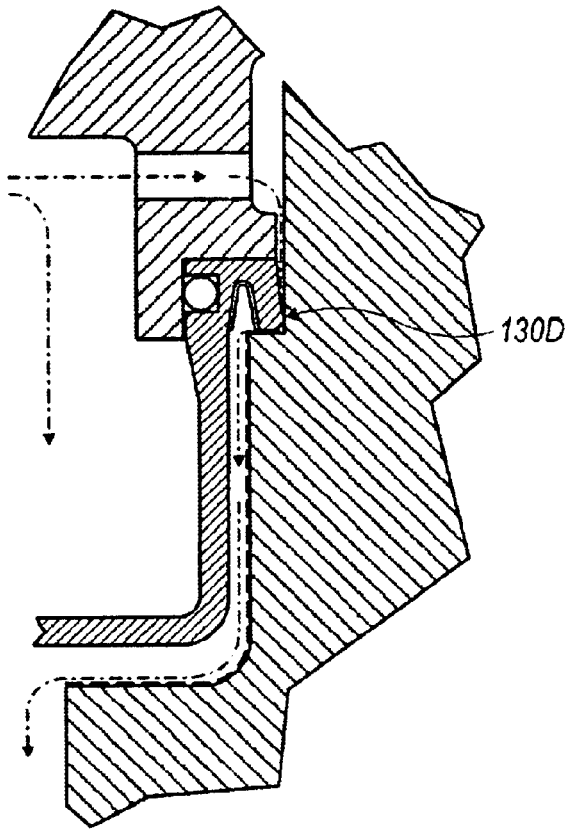

FIGS. 1D–1E show a second embodiment, in which a hydrostatically-asymmetric seal 130D is still integrated with the bladder (concave diaphragm) 100D of the pressure compensator, but is turned in the opposite direction to the embodiment of FIG. 1A.

FIG. 1D provides an sectional view of the bladder 100D, with a hydrostatically-asymmetric seal 130D as its turned-down lip, in place in the pressure compensator, and FIG. 1E shows the path of bypass (free) flow in this embodiment. Note that in this embodiment bypass flows of lubricant do not have to pass through the cavity 102. This is advantageous in that the pressure relief valve is more closely coupled to the bearings and seal, and this embodiment is presently preferred.

Alternative Embodiment with Separated Lip

Figure 1F:
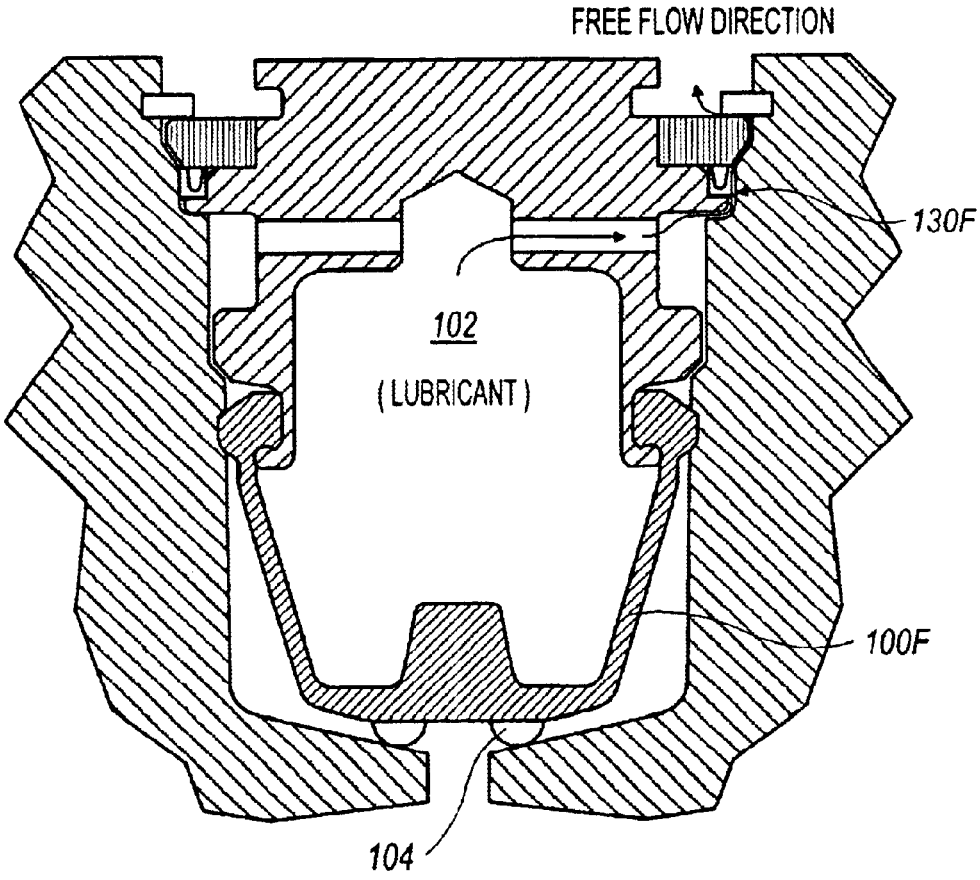
FIG. 1F shows a third embodiment, in which the hydrostatically-asymmetric seal is not integrated with the bladder, but is merely in close proximity to it.
Figure 2:
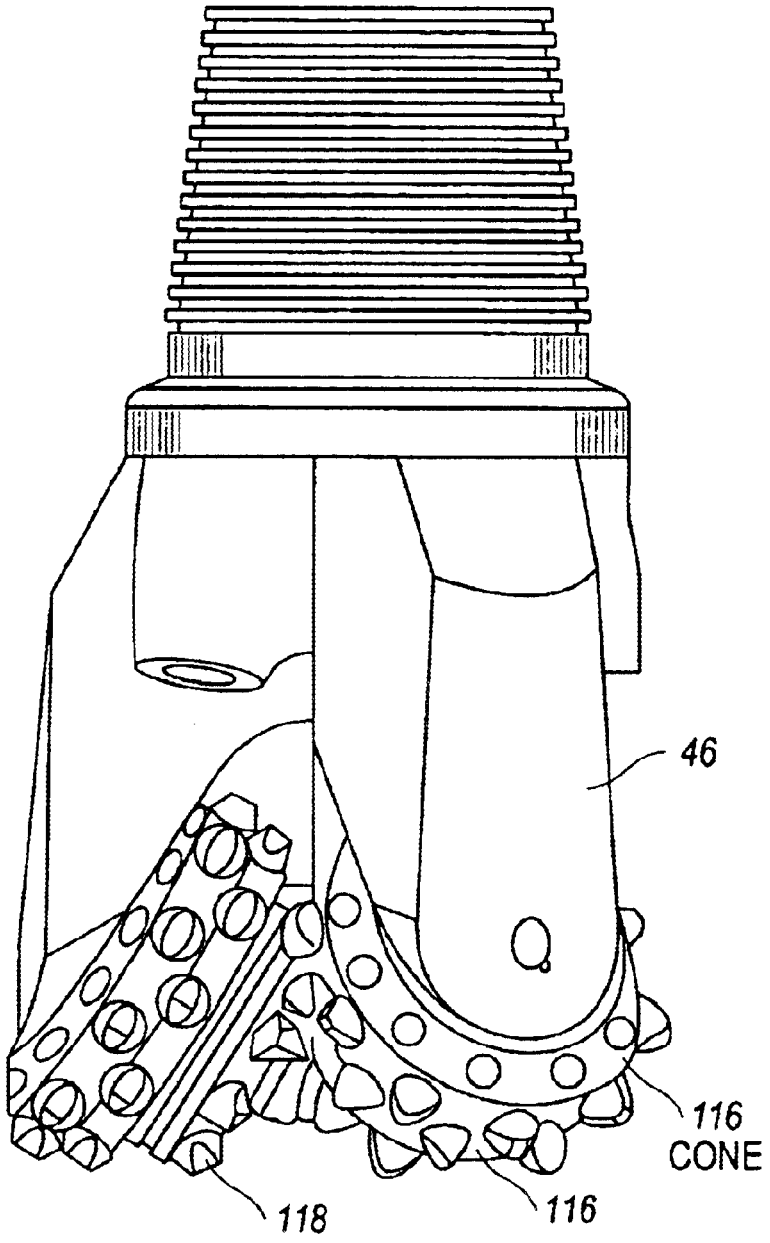
FIG. 2 shows a roller-cone-type bit.
Figure 3:
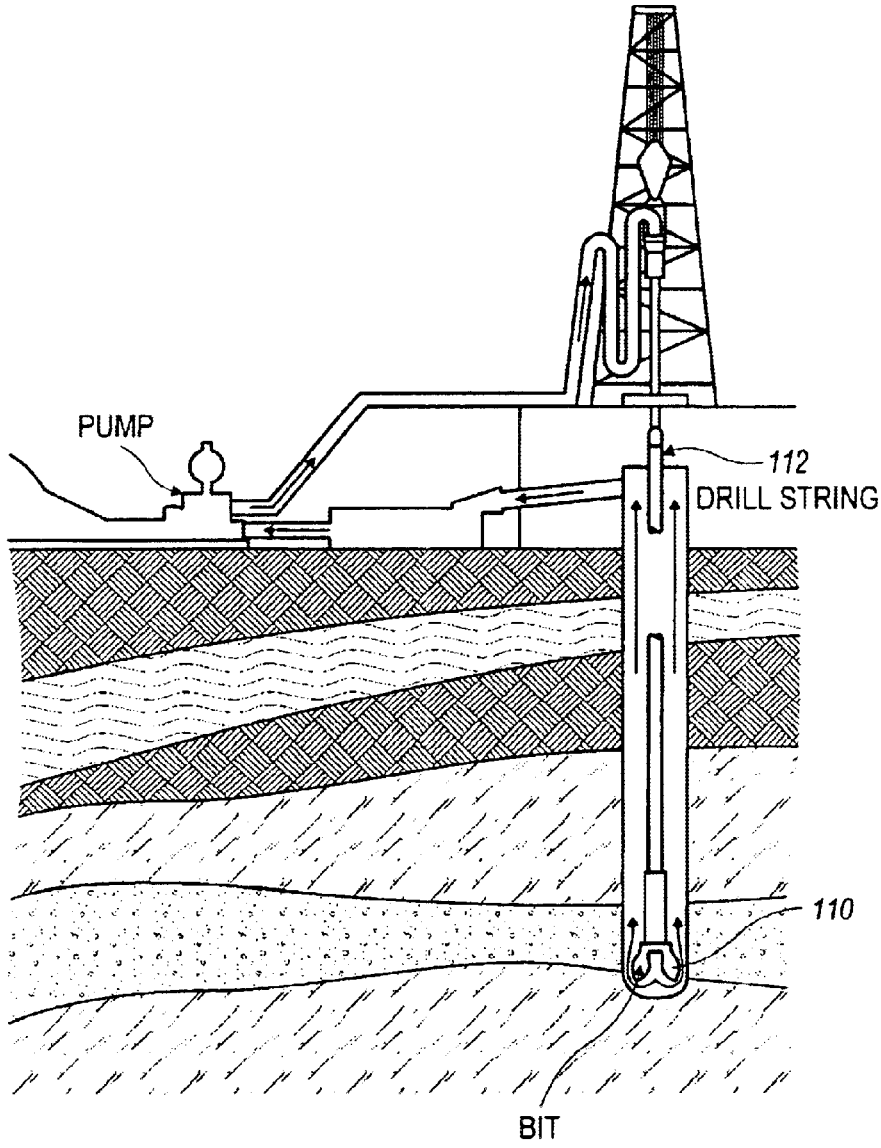
FIG. 3 shows a conventional drill rig.
Figure 4:
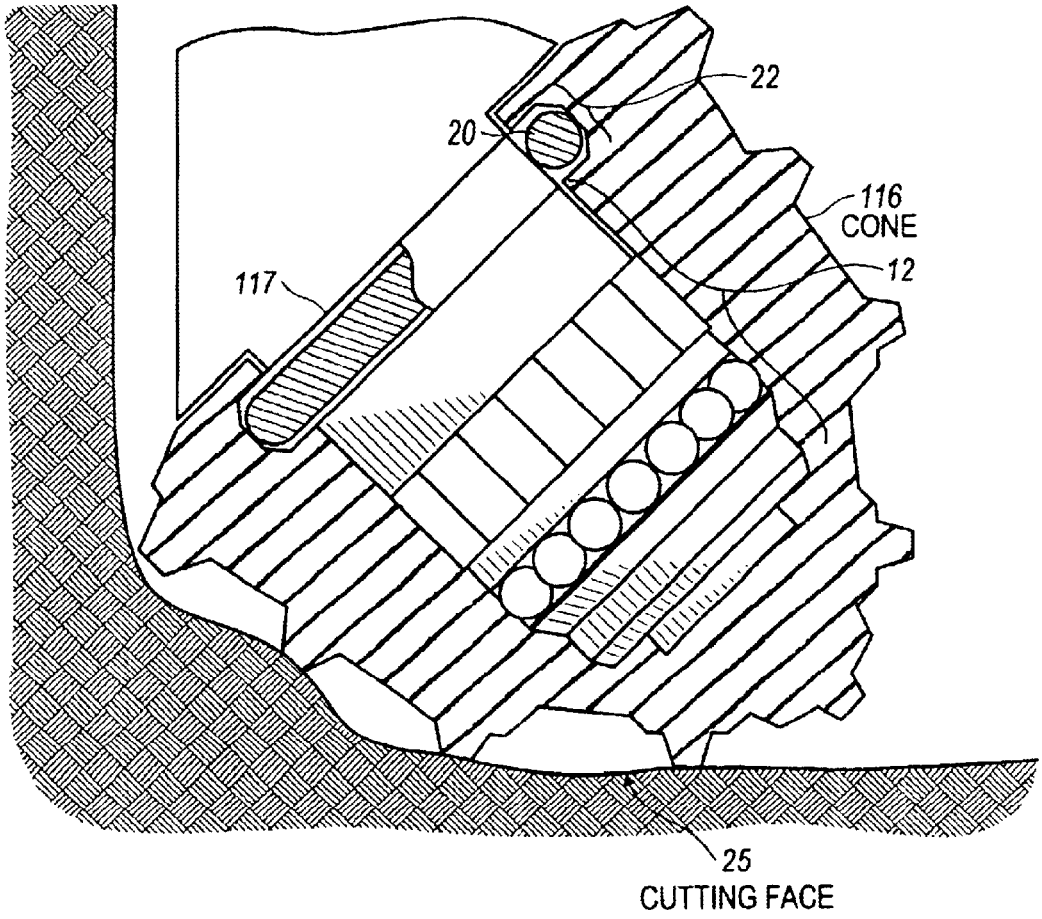
FIG. 4 shows a sectional view of a cone mounted on a spindle which extends from a bit's arm.
Figure 5:
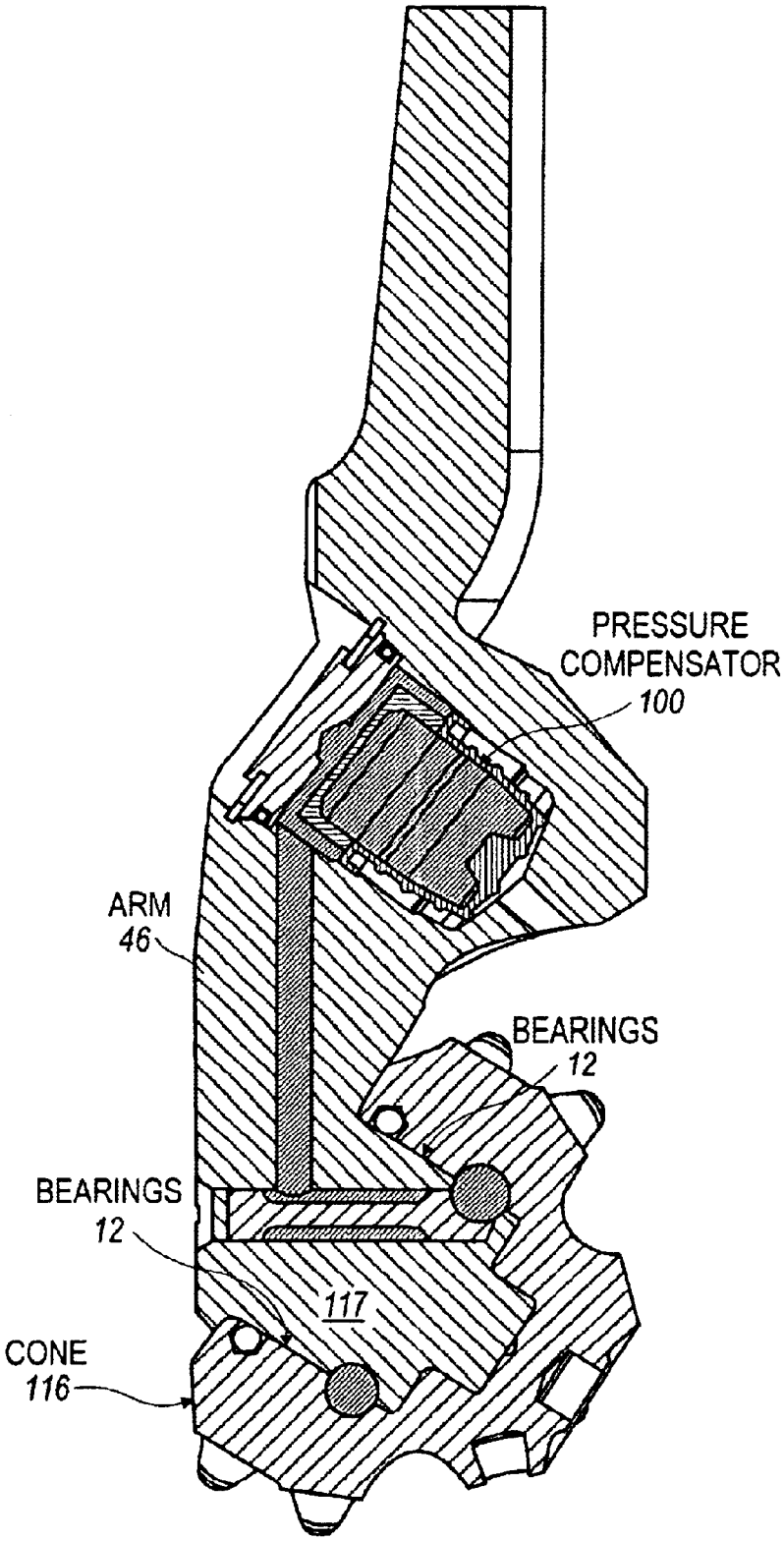
FIG. 5 shows a sectional view of a larger extent of a roller-cone-type bit's arm, including the pressure compensation system.

FIG. 1F shows a third embodiment, in which the hydrostatically-asymmetric seal 130F is not integrated with the bladder 100F, but is merely in close proximity to it.

In this class of alternative embodiments the seal preferably has a diameter which is at least half of the width of the opening of diaphragm 130F (to provide low-impedance bypass), and is axially separated from the bladder (along its central axis) by no more than half of the diaphragm diameter (to provide close coupling).

Note also that this FIG. explicitly illustrates the stand-off bumps 104, which keep the bladder separate from the surrounding metal surface, and allow reverse pressure surges to be communicated to the pressure relief valve.

This class of embodiments is generally less preferred, but is considered to be a possible adaptation of the ideas described above.

Note also that, in this embodiment, while the diaphragm needs to be an elastomer, the hydrostatically-asymmetric lip seal DOES NOT have to be.

Modifications and Variations

As will be recognized by those skilled in the art, the innovative concepts described in the present application can be modified and varied over a tremendous range of applications, and accordingly the scope of patented subject matter is not limited by any of the specific exemplary teachings given. Some contemplated modifications and variations are listed below, but this brief list does not imply that any other embodiments or modifications are or are not foreseen or foreseeable.

In alternative embodiments, TWO pressure relief valves can be used (possibly operating at different pressures), of which (e.g.) only one is a hydrostatically-asymmetric seal as described.

Most roller-cone bits today use journal bearings. However, the disclosed inventions are also applicable to rock bits which use rolling bearings (e.g. roller bearings or roller and ball).

In alternative embodiments the bit can have two or more compensator reservoirs per arm, or could have a central reservoir which feeds multiple arms.

In one class of alternative embodiments the grease (and/or the drill bit) can be heated during the filling operation, to reduce the viscosity of the grease.

A variety of materials can be used in implementing the disclosed inventions. The elastomeric diaphragm is nitrile rubber in the presently preferred embodiment, but can alternatively be made of neoprene or other suitably strong elastomer. The hydrostatically-asymmetric seal is preferably an integral part of a homogeneous diaphragm, but alternatively and less preferably the diaphragm can be inhomogeneous.

The "cones" of the roller-cone bit do not have to be (and typically are not) strictly conical nor frustro-conical. Typically the sides of a "cone" are slightly swelled beyond a conical shape, but the exact geometry is not very relevant to the operation of the disclosed inventions. The disclosed inventions are applicable to any sealed roller-cone bit.

While drill bits are the primary application, the disclosed inventions can also be applied, in some cases, to other rock-penetrating tools, such as reamers, coring tools, etc.

In various embodiments, various ones of the disclosed inventions can be applied not only to bits for drilling oil and gas wells, but can also be adapted to other rotary drilling applications (especially deep drilling applications, such as geothermal, geomethane, or geophysical research).

Additional general background on seals, which helps to show the knowledge of those skilled in the art regarding implementation options and the predictability of variations, can be found in the following publications, all of which are hereby incorporated by reference: SEALS AND SEALING HANDBOOK (4.ed. M. Brown 1995); Leslie Horve, SHAFT SEALS FOR DYNAMIC APPLICATIONS (1996); ISSUES IN SEAL AND BEARING DESIGN FOR FARM, CONSTRUCTION, AND INDUSTRIAL MACHINERY (SAE 1995); MECHANICAL SEAL PRACTICE FOR IMPROVED PERFORMANCE (ed. J. D. Summers-Smith 1992); THE SEALS BOOK (Cleveland, Penton Pub. Co. 1961); SEALS HANDBOOK (West Wickham, Morgan-Grampian, 1969); Frank L. Bouquet, INTRODUCTION TO SEALS AND GASKETS ENGINEERING (1988); Raymond J. Donachie, BEARINGS AND SEALS (1970); Leonard J. Martini, PRACTICAL SEAL DESIGN (1984); Ehrhard Mayer, MECHANICAL SEALS (trans. Motor Industry Research Association, ed. B. S. Nau 1977); and Heinz K. Muller and Bernard S. Nau, FLUID SEALING TECHNOLOGY: PRINCIPLES AND APPLICATIONS (1998).

Additional general background on drilling, which helps to show the knowledge of those skilled in the art regarding implementation options and the predictability of variations, may be found in the following publications, all of which are hereby incorporated by reference: Baker, A PRIMER OF OILWELL DRILLING (5.ed. 1996); Bourgoyne et al., APPLIED DRILLING ENGINEERING (1991); Davenport, HANDBOOK OF DRILLING PRACTICES (1984); DRILLING (Australian Drilling Industry Training Committee 1997); FUNDAMENTALS OF ROTARY DRILLING (ed. W. W. Moore 1981); Harris, DEEPWATER FLOATING DRILLING OPERATIONS (1972); Maurer, ADVANCED DRILLING TECHNIQUES (1980); Nguyen, OIL AND GAS FIELD DEVELOPMENT TECHNIQUES: DRILLING (1996 translation of 1993 French original); Rabia, OILWELL DRILLING ENGINEERING/PRINCIPLES AND PRACTICE (1985); Short, INTRODUCTION TO DIRECTIONAL AND HORIZONTAL DRILLING (1993); Short, PREVENTION, FISHING & REPAIR (1995); UNDERBALANCED DRILLING MANUAL (Gas Research Institute 1997); the entire PetEx Rotary Drilling Series edited by Charles Kirkley, especially the volumes entitled MAKING HOLE (1983), DRILLING MUD (1984), and THE BIT (by Kate Van Dyke, 4.ed. 1995); the SPE reprint volumes entitled "Drilling," "Horizontal Drilling," and "Coiled-Tubing Technology"; and the Proceedings of the annual IADC/SPE Drilling Conferences from 1990 to date; all of which are hereby incorporated by reference.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A bit for downhole rotary drilling, comprising:

one or more rotary cutting elements, each rotatably mounted to bearings on a spindle;

at least one pressure compensation reservoir fluidly connected to said bearings; and a pressure relief valve fluidly connected to relieve overpressure inside said reservoir, said pressure relief valve comprising a hydrostatically-asymmetric seal which allows fluid passage easily in only one direction.

2. The bit of claim 1, wherein said seal is a vee-shaped seal.

3. The bit of claim 1, wherein said seal is integral with said diaphragm.

4. The bit of claim 1, wherein said seal is wider than said diaphragm.

5. The bit of claim 1, wherein said reservoir is made entirely of an elastomeric material.

6. The bit of claim 1, wherein said seal is a metal-backed elastomer.

7. The bit of claim 1, wherein said diaphragm further comprises at least one stand-off protrusion, integral therewith, which prevents said diaphragm from sealing off flows past the outer surfaces of said diaphragm.

8. A method of manufacturing a roller-cone-type bit, comprising the actions of:

providing an assembled bit according to claim 1;

applying a vacuum to said reservoir thereof; and then supplying lubricant to said reservoir under pressure, at least until excess lubricant flows past said seal.

9. A method for rotary drilling, comprising the actions of:

applying torque and weight-on-bit, and supplying drilling fluid, to a drill sting bearing a roller-cone-type bit according to claim 1.

10. A rotary drilling system, comprising:

roller-cone-type bit according to claim 1 mounted on a drill string; and machinery which applies torque and weight-on-bit to said drill string, to thereby extend a borehole into the Earth.

11. A bit for downhole rotary drilling, comprising:

one or more rotary cutting elements, each rotatably mounted to bearings on a spindle;

at least one pressure compensation reservoir fluidly connected to said bearings; and a pressure relief valve fluidly connected to relieve overpressure inside said reservoir, said pressure relief valve comprising a hydrostatically-asymmetric seal;

wherein said seal is more than half as wide as said diaphragm, and is axially separated from said diaphragm by less than half the width of said diaphragm.

12. A bit for downhole rotary drilling, comprising:

one or more rotary cutting elements, each rotatably mounted to bearings on a spindle;

at least one pressure compensation reservoir fluidly connected to said bearings; and a pressure relief valve fluidly connected to relieve overpressure inside said reservoir, said pressure relief valve consisting of a hydrostatically-asymmetric seal which is integral with said reservoir and which allows fluid passage easily in only one direction.

13. The bit of claim 12, wherein said seal is a vee-shaped seal.

14. The bit of claim 12, wherein said seal is wider than said diaphragm.

15. The bit of claim 12, wherein said reservoir is made entirely of an elastomeric material.

16. The bit of claim 12, wherein said diaphragm further comprises at least one stand-off protrusion, integral therewith, which prevents said diaphragm from sealing off flows past the outer surfaces of said diaphragm.

17. The bit of claim 12, wherein said seal is a metal-backed elastomer.

18. A method for rotary drilling, comprising the actions of:

applying torque and weight-on-bit, and supplying drilling fluid, to a drill string beating a roller-cone-type bit according to claim 12.

19. A method of manufacturing a roller-cone-type bit, comprising the actions of:

providing an assembled bit according to claim 12;

applying a vacuum to said reservoir thereof; and then supplying lubricant to said reservoir under pressure, at least until excess lubricant flows past said seal.

20. A rotary drilling system, comprising:

a roller-cone type bit according to claim 12 mounted on a drill string; and machinery which applies torque and weight-on-bit to said drill string, to thereby extend a borehole into the Earth.

21. A bit for downhole rotary drilling, comprising:

one or more rotary cutting elements, each rotatably mounted to bearings on a spindle;

at least one pressure compensation reservoir fluidly connected to said bearings; and a pressure relief valve fluidly connected to relieve overpressure inside said reservoir, said pressure relief valve comprising a hydrostatically-asymmetric seal which is integral with said reservoir and which is oriented so that flow into said reservoir and bypass flow through said seal are in the same direction.

22. The bit of claim 21, wherein said seal is a vee-shaped seal.

23. The bit of claim 21, wherein said diaphragm further comprises at least one stand-off protrusion, integral therewith, which prevents said diaphragm from scaling off flows past the outer surfaces of said diaphragm.

24. The bit of claim 21, wherein said seal is wider than said diaphragm.

25. The bit of claim 21, wherein said reservoir is made entirely of an elastomeric material.

26. The bit of claim 21, wherein said seal is a metal-backed elastomer.

27. A method for rotary drilling, comprising the actions of:

applying torque and weight-on-bit, and supplying drilling fluid, to a drill string bearing a roller-cone-type bit according to claim 21.

28. A method of manufacturing a roller-cone-type bit, comprising the actions of:

providing an assembled bit according to claim 21;

applying a vacuum to said reservoir thereof; and then supplying lubricant to said reservoir under pressure, at least until excess lubricant flows past said seal.

29. A rotary drilling system, comprising:

a roller-cone-type bit according to claim 21 mounted on a drill string; and machinery which applies torque and weight-on-bit to said drill string, to thereby extend a borehole into the Earth.

30. An elastomeric lubricant reservoir diaphragm having a hydrostatically-asymmetric seal integral therewith, at a lip thereof which surrounds a cavity, said seal allows fluid passage easily in only one direction;

whereby said seal provides pressure relief for overpressures inside said cavity.

31. The diaphragm of claim 30, wherein said seal is a metal-backed elastomer.

32. The diaphragm of claim 30, wherein said seal is vee-shaped.

33. The diaphragm of claim 30, further comprising stand-off nubs on the exterior thereof.

* * * * *